US006994561B2

(12) United States Patent
Pepe

(10) Patent No.: US 6,994,561 B2
(45) Date of Patent: Feb. 7, 2006

(54) CROSS CONNECT INTERFACE MODULE

(75) Inventor: Paul John Pepe, Clemmons, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/844,841

(22) Filed: May 13, 2004

(65) Prior Publication Data

US 2005/0266719 A1 Dec. 1, 2005

(51) Int. Cl.
*H01R 29/00* (2006.01)

(52) U.S. Cl. ..... 439/49; 439/490; 439/709; 439/922; 361/796

(58) Field of Classification Search ..... 439/409, 439/76.1, 49, 490, 709, 922; 361/803, 796
See application file for complete search history.

(56) References Cited

U.S. PATENT DOCUMENTS 5,483,409 A * 1/1996 Heidorn et al. ..... 361/119
5,667,402 A 9/1997 Denovich et al. ..... 439/409
5,761,052 A * 6/1998 Wheeler-King et al. .... 361/803
6,243,273 B1 * 6/2001 Beun et al. ..... 361/796
6,291,767 B1 * 9/2001 Beecher et al. ..... 174/50
6,377,471 B1 * 4/2002 Chong et al. ..... 361/796
6,445,595 B2 * 9/2002 Okamoto ..... 361/826
6,482,039 B2 * 11/2002 Phommachanh et al. ... 439/620
6,881,099 B2 * 4/2005 Henneberger et al. ..... 439/668
2005/0085119 A1 * 4/2005 Schluter et al. ..... 439/395

FOREIGN PATENT DOCUMENTS

WO WO 03/079599 A2 9/2003

* cited by examiner

*Primary Examiner*—Michael C. Zarroli

(57) ABSTRACT

An interface module for collecting sensor signals at a cross connect block includes a circuit board having an upper side and an opposite lower side. The upper side is configured to receive a plurality of individual sensor signals. The lower side includes at least one connector that includes a plurality of contacts. The sensor signals are communicated to the plurality of contacts in a pre-determined pattern.

18 Claims, 5 Drawing Sheets

CROSS CONNECT INTERFACE MODULE

BACKGROUND OF THE INVENTION

The invention relates generally to connector interface modules for a monitored network and, more particularly, to an interface module for monitoring network activity at the cross connect level.

In order to better operate large electronic networks, sensor systems have been developed to monitor connections between components within the network. The sensor systems typically are incorporated in the connections to interconnect modules on the network. The interconnect module allows connections between the two network components to be made by using a patch cord that is connected to another network resource. The sensor system commonly includes a spring-loaded pin on the receptacle or modular patch cord plug that is depressed and released when connections and disconnections are made. Spring-loaded pins, though frequently used for connection sensing, do not lend themselves well to interconnect module connection sensing due to alignment problems and space limitations.

A cross connect is a wall mounted rack system that is an alternative to a patch panel. Typically, at the cross connect, all connections are wire connections to insulation displacement contacts (IDC) in a wiring block, that is, patch cords are not used. Consequently, monitoring of the network at the cross connect level is more cumbersome. With a patch panel, sensor pads can be positioned so that a patch cord can be fitted with a conductor to carry a sensor signal. At the cross connect, a direct wire connection for the sensor signal must be provided which is then routed to the network monitoring system.

The cross connect system is generally housed in a wiring closet which is a central distribution point for most of the network resources available at a site. In the wiring closet, cable terminations are typically made at the cross connect wiring blocks using a "punch down" tool. Network monitoring would be facilitated if physical connections to the network could be monitored in the wiring closet. Conventional sensor probe configurations, however, are incompatible with the punch down blocks that are commonly used in the wiring closet.

A need exists for a sensing assembly that can be used in sensing network connections made in the wiring closet at the cross connect wiring blocks.

BRIEF DESCRIPTION OF THE INVENTION

In one aspect, an interface module for collecting sensor signals at a cross connect block is provided. The module includes a circuit board having an upper side and an opposite lower side. The upper side is configured to receive a plurality of individual sensor signals. The lower side includes at least one connector that includes a plurality of contacts. The sensor signals are communicated to the plurality of contacts in a pre-determined pattern.

Optionally, the at least one connector includes a first connector and a second connector. The first connector is associated with a first wiring block on the cross connect block and the second connector is associated with a second wiring block on the cross connect block that is different from the first wiring block. The interface module also includes a top housing coupled to a bottom housing and the circuit board is positioned between the top and bottom housings. The upper side of the circuit board includes a plurality of upper connectors receiving the sensor signals and a plurality of traces electrically connecting the plurality of upper connectors to the fat least one connector. Alternatively, the upper side of the circuit board includes a plurality of upper connectors, each of which receives a sensor signal associated with a first wiring block and a sensor signal associated with a second wiring block different from the first wiring block. Each individual sensor signal is carried by an associated conductor in a multi-pair cabling system.

In another aspect, an interface module for collecting sensor signals at a cross connect block is provided that includes a bottom housing, a top housing coupled to the bottom housing, and a circuit board disposed between the top and bottom housings. The circuit board includes an upper side and an opposite lower side. The upper side is configured to receive a plurality of individual sensor conductors, and the lower side includes at least one connector. Each individual sensor conductor is electrically connected to the at least one connector.

In another aspect, an interface module for collecting sensor signals at a cross connect block is provided. The module includes a circuit board having an upper side and an opposite lower side. The upper side includes a plurality of upper connectors, each configured to receive a pair of individual sensor signals. One of the pair of sensor signals is associated with a first wiring block on the cross connect block and the other of the pair of sensor signals is associated with a second wiring block on the cross connect block different from the first wiring block. The lower side of the circuit board includes a first lower connector and a second lower connector, wherein the first lower connector is associated with the first wiring block and the second lower connector is associated with the second wiring block. Each of the plurality of upper connectors is in electrical communication with each of the first and second lower connectors.

DETAILED DESCRIPTION OF THE INVENTION

Figure 1:
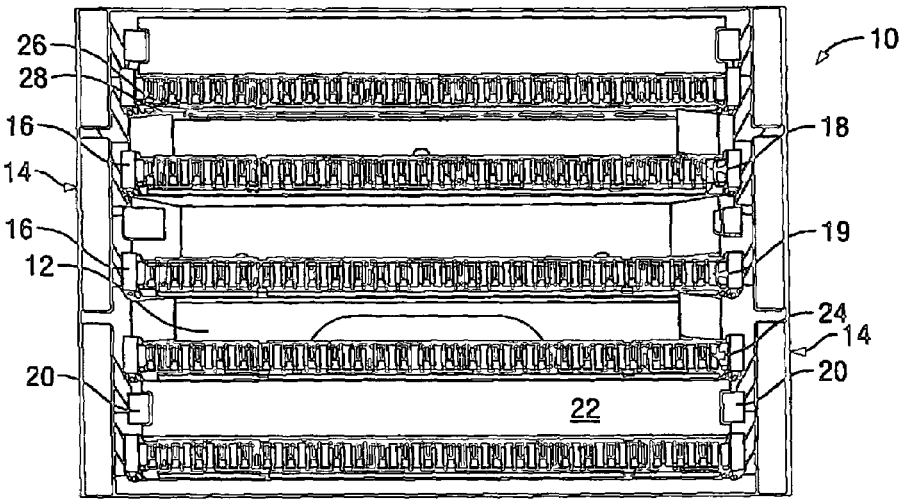
FIG. 1 (PRIOR ART)
FIG. 1 is a partial top view of a known cross connect block.

FIG. 1 illustrates a known cross connect block 10 that is commonly used in network wiring closets. The cross connect block 10 is modular and more than one cross connect block may be found in the typical wiring closet. The cross connect block 10 includes a base 12 that can be mounted on a wall or panel. A number of modular access blocks 14 extend upwardly from the base 12. The access blocks 14 include stands 16 that form receptacles for a pair of wiring blocks 18, 19 that extend transversely across the cross connect block 10 between opposed stands 16. The access blocks 14 also include tabs 20 that hold a label 22. The wiring blocks 18, 19 include wire termination slots 24, on both an upper edge 26 and a lower edge 28, each of which includes an insulation displacement contact (IDC) (not shown) that pierces the insulation on a wire (not shown) to make contact with the conductor within. Typically, resource connections are made at the lower edge 28 of the wiring block 18, 19 and the resources are accessed by making connections at the corresponding slots 24 at the upper edge 26 of the wiring block 18, 19.

Figure 2:
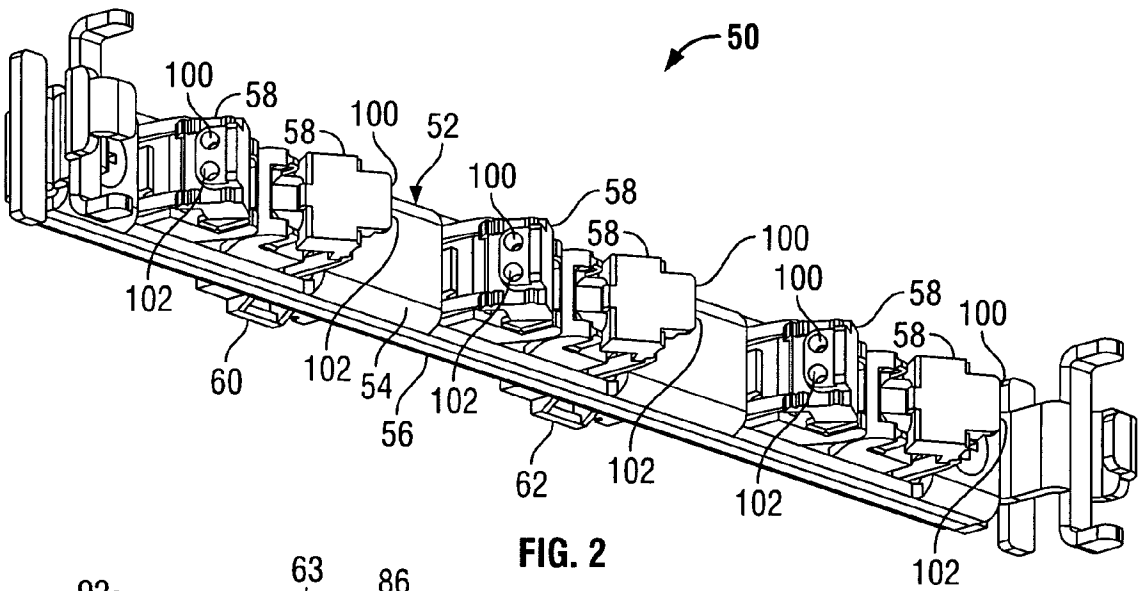
FIG. 2 is a perspective view of an interface module in accordance with an embodiment of the present invention.

FIG. 2 illustrates an interface module 50 formed in accordance with an exemplary embodiment of the present invention. The interface module 50 includes a housing 52 that has a top housing portion 54 and a bottom housing portion 56. A number of upper connectors 58 extend upwardly from the interface module 50. Lower connectors 60 and 62 extend downwardly from the module 50. In the exemplary embodiment, two lower connectors 60 and 62 extend downwardly from the module 50. Optionally, only one lower connector, or more than two lower connectors may be present. The interface module 50 is sized to be received between adjacent wiring blocks 18, 19 on an access block 14 (see FIGS. 5 and 6). The module 50 provides network sensing capability at the cross connect block 10.

Figure 3:
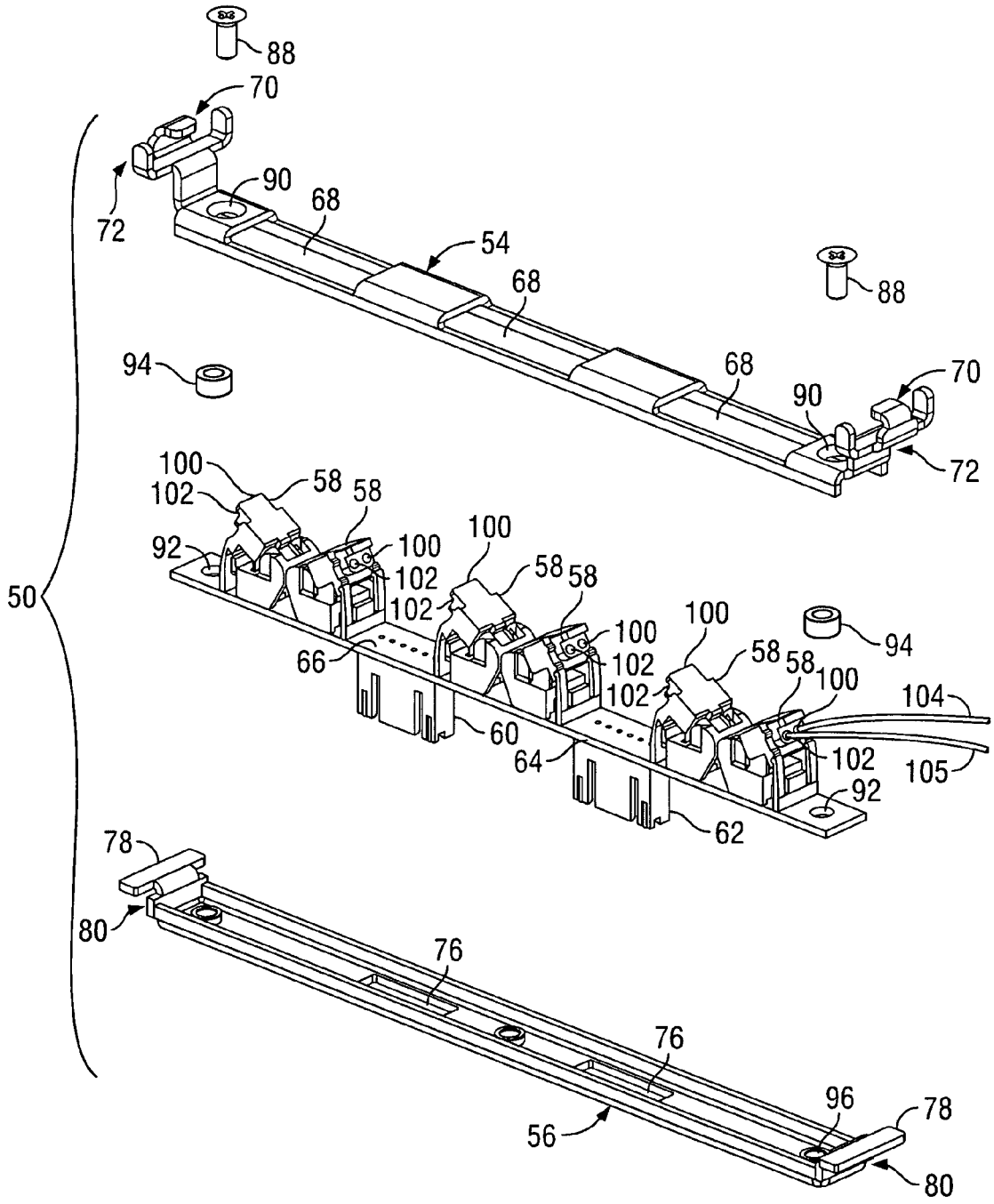
FIG. 3 is an exploded view of the interface module shown in FIG. 2.

FIG. 3 illustrates a top exploded view of the interface module 50. The interface module 50 includes a circuit board 64 that is retained between the top housing 54 and the bottom housing 56. The housing 52 (FIG. 2) provides a protective enclosure for the circuit board 64. The upper connectors 58 are mounted to an upper surface 66 of the circuit board 64. The upper connectors 58 extend upwardly through openings 68 in the top housing 54. The top housing 54 also includes a label holder 70 at each end 72 for holding an identifying label. The bottom housing 56 includes openings 76 through which the first and second lower connectors 60 and 62 extend. The bottom housing 56 also includes a tab 78 at each end 80 that is received in the label holder 70 in the cross connect block 10. In an exemplary embodiment, the bottom housing 56 is received in the cross connect block 10 with a snap fit.

Figure 4:
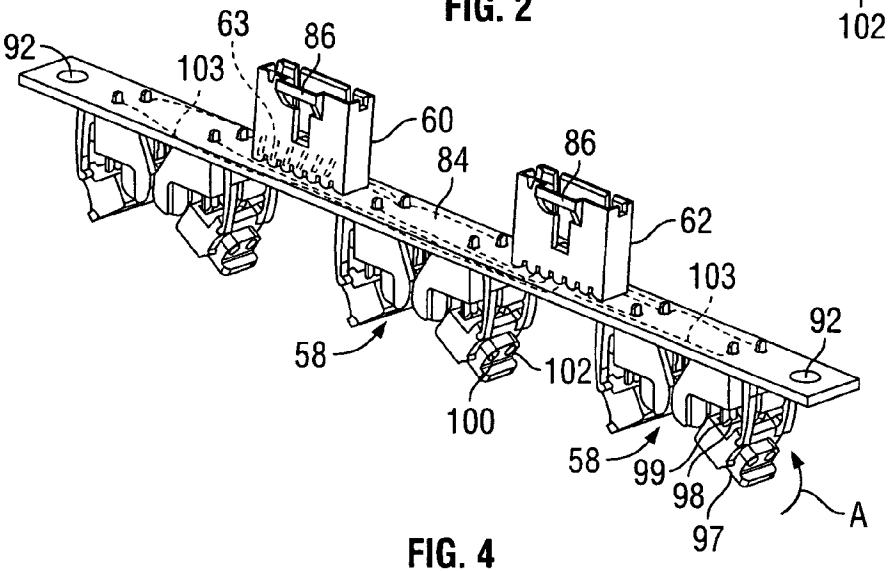
FIG. 4 is a bottom perspective view of the circuit board shown in Figure and 3.

Each upper connector 58 includes a first receptacle 100 and a second receptacle 102, each of which includes a terminal contact 99 (see FIG. 4). Each terminal contact 99 in each of receptacles 100 and 102 is connected to a corresponding terminal contact 63 (see FIG. 4) in one of the first and second lower connectors 60 and 62, respectively, by circuit traces 103 on the circuit board 64. Each receptacle 100, 102 is configured to receive an individual conductor 104, 105 that carries a sensor signal that is associated with a connection that is made to a wiring block 18. As shown in FIGS. 2 and 3, the interface module 50 can accommodate a total of twelve sensor connections corresponding to the resource connections made to the wiring blocks 18 and 19. In an exemplary embodiment, the upper connectors 58 are pivot connectors and the contacts within the receptacles 100 are insulation displacement contacts (IDC), as described in more detail in FIG. 4. It is to be understood, however, that other types of connectors as well as other types of contacts are not intended to be excluded.

Fasteners 88 are provided for coupling the top housing 54 and bottom housing 56 together. The top housing 54 and the circuit board 64 include apertures 90 and 92 respectively that receive fasteners 88. Spacers 94 are positioned between the top housing 54 and the circuit board 64. The fasteners 88 are received in receptacles 96 for joining the top and bottom housings 54, and 56 respectively, together. In an exemplary embodiment, fasteners 88 are threaded screws and receptacles 96 are threaded inserts in the bottom housing 56. In alternative embodiments, it is anticipated that other known suitable fasteners may be used.

FIG. 4 illustrates a bottom perspective view of the circuit board 64. The lower connectors 60 and 62 are mounted to and extend from a lower side 84 of the circuit board 64. Each lower connector 60 and 62 includes a plurality of electrical contacts 63, (shown in phantom lines). In one embodiment, the contacts 63 are pin contacts; however, it is to be understood that in alternative embodiments, other contact designs may be used. In an exemplary embodiment, each lower connector 60 and 62 includes six electrical contacts 63. It is understood that if other than two lower connectors are used, the number of contacts 63 in each lower connector may also vary. Each lower connector 60 and 62 also includes a latch member 86 for retaining a mating connector (not shown).

As shown most clearly in FIG. 4, each pivot connector 58 has a pivoting head 97 that includes the receptacles 100 and 102. A slot 98 extends into an interior end of the receptacles 100 and 102. The slot 98 receives IDC contacts 99 when the pivot head 97 is pushed downward, pivoting in the direction of the arrow A. When a wire or conductor is inserted into the receptacles 100, 102, the pivot head 97 is pushed downward and the IDC contacts 99 pierce the conductor insulation to make electrical contact. The IDC contacts 99 are mounted on the circuit board 64 and extend from the upper surface 66 of the circuit board 64. It is to be noted that IDC contacts 99 are present in pairs, one for receptacle 100 and one for receptacle 102, with only one contact 99 being visible in FIG. 4.

Use of the interface module 50 will now be described with respect to a four-pair cabling system. It is to be understood that the four-pair system is used for purposes of illustration only and no limitation is intended thereby. Each termination to the cross connect block 10 will be accompanied by a separate but associated conductor carrying a sensor signal.

Figure 5:
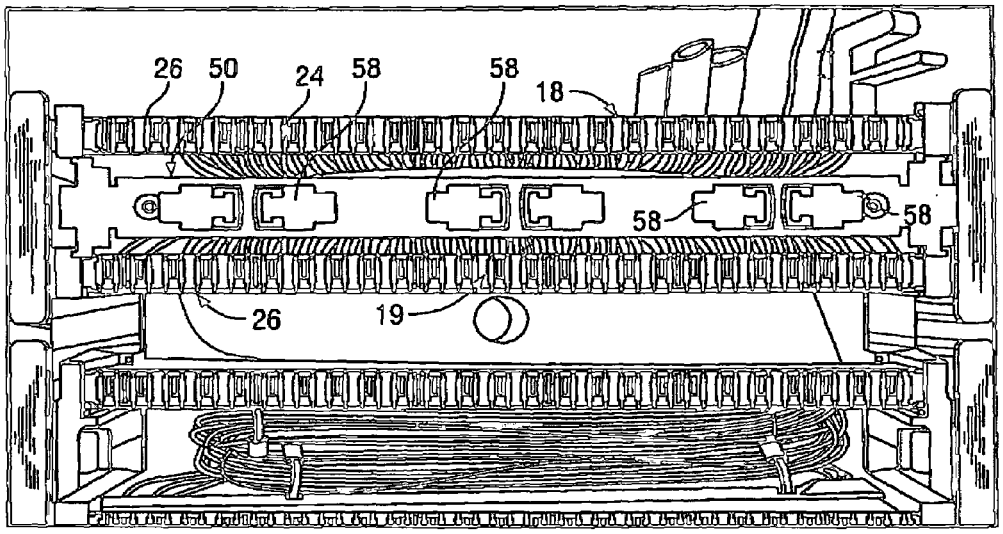
FIG. 5 is a top view of interface module shown in FIG. 2 installed on a cross connect.

FIG. 5 illustrates the interface module 50 installed in a cross connect block such as the cross connect block 10 (shown in FIG. 1). With reference to FIGS. 2, 3, and 5, the interface module 50 is positioned between adjacent wiring blocks 18 and 19, wherein wiring block 18 is a first wiring block and wiring block 19 is a second wiring block. Each wiring block 18, 19 includes fifty individual termination slots 24. In a four-pair system, a total of eight wires are used for each connection to the wiring block 18, 19. Thus, there is the capacity for six connections on each wiring block 18, 19, with two termination slots 24 on each wiring block 18, 19 not being used. The terminal contacts 99 in the receptacles 100 of the pivot connectors 58 comprise a set of first contacts 99 on the upper side 66 of the circuit board 64. The terminal contacts 99 in receptacles 102 comprise a set of second contacts 99 on the upper side 66 of the circuit board 64. In one embodiment, both the first contacts 99 and the second contacts 99 are IDC contacts.

In the pivot connectors 58, there are a total of six first contacts 99, one in each receptacle 100 and six second contacts 99, one in each receptacle 102 arranged so that the first contacts 99 service wiring block 18 and the second contacts 99 service wiring block 19. That is, sensor wires 104 for the first wiring block 18, and only the first wiring block 18, are connected to the first contacts 99 and sensor wires 105 for the second wiring block 19, and only the second wiring block 19, are connected to the second contacts 99. Thus, the first contacts 99 are associated with a first wiring block 18 and the second contacts 99 are associated with a second wiring block 19 different from the first wiring block 18. Further, the sensor signals received by the first contacts 99 are also associated with the first wiring block 18 while the sensor signals received by the second contacts 99 are associated with the second wiring block 19 that is different from the first wiring block 18.

The first and second wiring blocks 18 and 19 have network resources (not shown) wired to them at their lower edges 28 (see FIG. 1). The network resources are accessed when wiring terminations are made in corresponding termination slots 24 at the upper edges 26 of the wiring blocks 18, 19. When a network connection is made on the first wiring block 18, four wire pairs (not shown) are punched into the appropriate termination slots 24 on the wiring block 18 and a separate associated conductor 104 (FIG. 3) carrying a sensor signal is connected to the associated first contact 99 in the pivot connector 58. When a network connection is made on the second wiring block 19, four wire pairs (not shown) are punched into the appropriate termination slots 24 on the wiring block 19 and another separate associated conductor 105 (FIG. 3) carrying a sensor signal is connected to the associated second contact 99 in the pivot connector 58. Therefore, each sensor signal is carried by a separate and associated conductor 104, 105 that is coupled with the four-pair cabling system. When a signal conductor 104, 105 is connected to one of the first and second contacts 99 on the upper side of the circuit board 64, the contact 99 becomes associated with a set of wiring terminations in the four-pair system on one of the wiring blocks 18, 19.

The circuit board 64 includes circuit traces 103 that electrically connect each of the first upper side contacts 99 with a contact 63 in the first lower connector 60. Similarly, circuit traces 103 on the circuit board 64 electrically connect each of the second upper side contacts 99 with a contact 63 in the second lower connector 62. The traces 103 may be either on the surface of the circuit board 64 or, alternatively, the traces 103 may be internal circuit board traces. Thus, when the sensor conductors 104, 105 are received in the pivot connectors 58 on the upper side 66 of the circuit board 64, each contact 63 in the first and second lower connectors 60 and 62, respectively, is electrically connected to one of the sensor conductors 104, 105. In addition, through the sensor conductor connections, the first lower connector 60 is associated with the first wiring block 18 and the second lower connector 62 is associated with the second wiring block 19. That is, when sensor signals are received on the first side 66 of the circuit board 64, the first lower connector 60 is associated with the first wiring block 18 on the cross connect 10 and the second lower connector 62 is associated with a second wiring block 19 on the cross connect 10, different from the first wiring block 18. The sensor signals, therefore, are communicated to the contacts 63 in the lower connectors 60 and 62 in a pre-determined pattern.

In an exemplary embodiment, first lower connector 60 and second lower connector 62 are six pin connectors wherein each pin carries a sensor signal that originates from an associated conductor connection to one of the pivot connectors 58. It should be apparent that each lower connector 60, 62 carries sensor signals associated with terminations made to only one wiring block. When a six wire I/O cable is mated to the lower connectors 60 and 62, the sensor signals can be routed to a network monitoring system (not shown) thus establishing network monitoring at the cross connect level.

Figure 6:
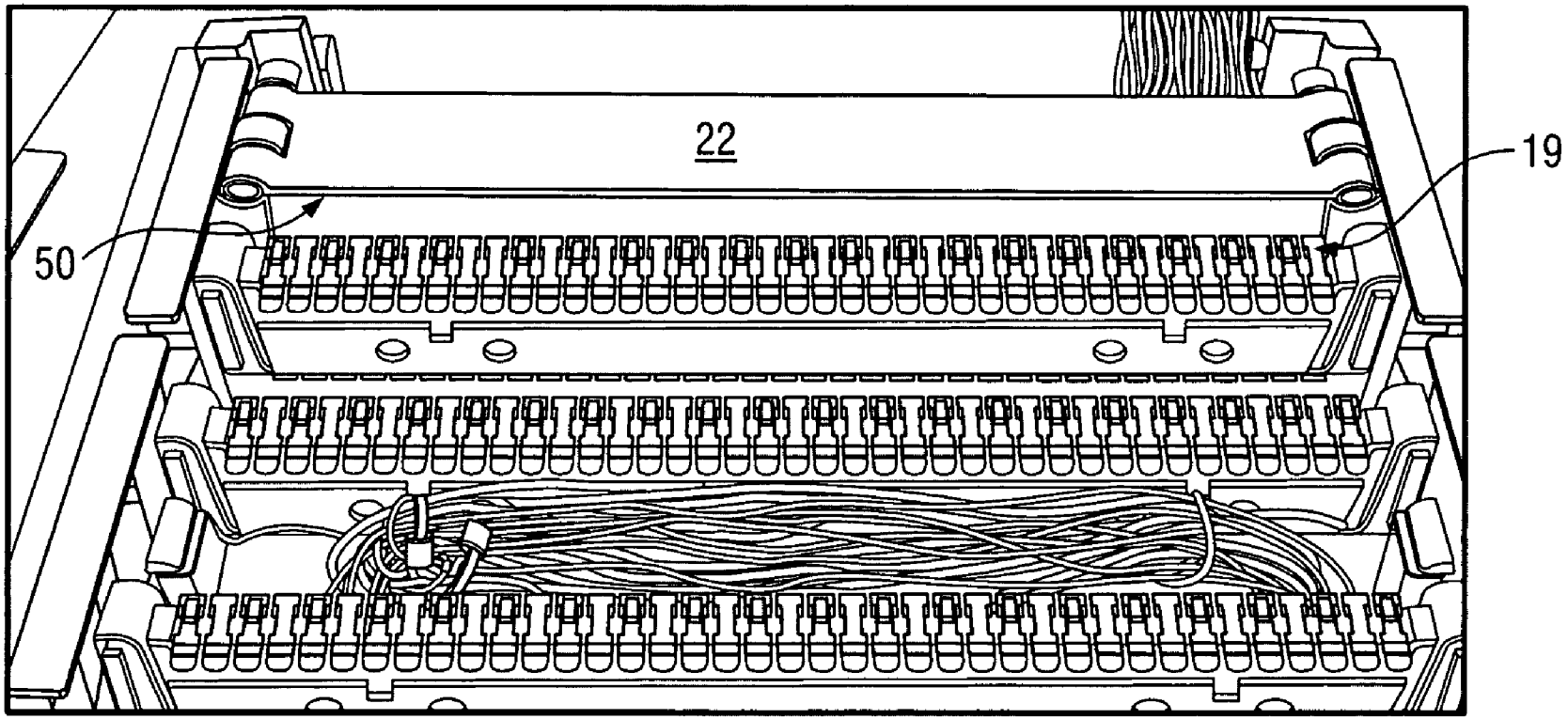
FIG. 6 is a top perspective view of the interface module shown in FIG. 5 with a label in place.

FIG. 6 illustrates the interface module 50 installed in a cross connect block 10. In FIG. 6, a label 22 is installed in the label holder 70 on the top housing 54. With the label 22 in place, the connections to the wiring blocks 18, 19 can be identified. The availability of the label 22 is particularly advantageous for identifying the wiring block connections when individual wire terminations are used.

Figure 7:
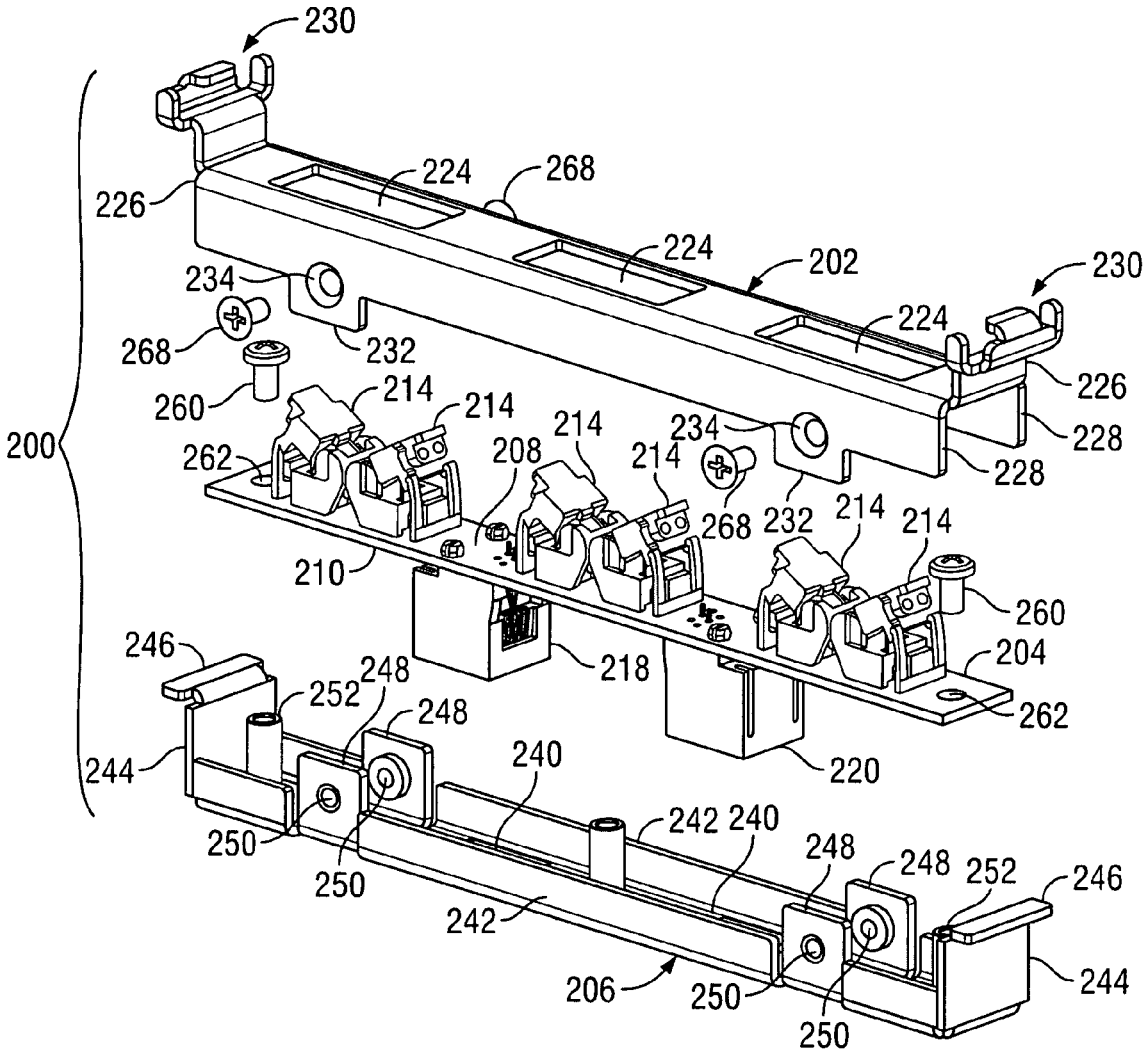
FIG. 7 is an exploded view of an interface module according to an alternate embodiment of the present invention.

FIG. 7 is an exploded view of an alternative embodiment of an interface module 200. The module 200 includes a top housing 202, a circuit board 204, and a bottom housing 206. The circuit board 204 is held between the top housing 202 and the bottom housing 206. The circuit board 204 includes an upper side 208 and an opposite lower side 210. A number of pivot connectors 214 are mounted on the upper surface 208 of the circuit board 204. As with the module 50, each pivot connector 214 includes a pair of contacts (not shown) that in one embodiment can be IDC contacts. Lower connectors 218 and 220 are mounted on the lower side 210 of the circuit board. In the embodiment shown, the lower connectors 218, 220 are RJ-11 receptacle jacks. As with the previously described embodiment, the number of lower connectors 218, 220 may greater than or less than two.

The top housing 202 includes openings 224 through which the pivot connectors 214 extend. The top housing 202 has opposed ends 226 and side panels 228. Each end 226 has a label holder 230. Each side panel 228 includes a pair of tabs 232 and assembly holes 234.

The bottom housing 206 includes openings 240 through which the lower connectors 218 and 220 extend. The bottom housing has opposed side panels 242 and opposed ends 244. Each end 244 includes a tab 246 that is received in the label holder 20 of the cross connect 10 to hold the interface module 200 in the space between adjacent wiring blocks 18 and 19. Each side 242 of the housing bottom 206 includes recessed assembly tabs 248 that each includes a threaded aperture 250. Internally threaded mounting posts 252 extend vertically upward from the interior of the bottom housing 206.

The interface module 200 is assembled by first attaching the circuit board 204 to the bottom housing using fasteners 260 which are inserted through apertures 262 in the circuit board 204 and fastened into the mounting posts 252. The top housing 202 is then positioned on the bottom housing 206 so that the recessed tabs 248 on the bottom housing are inside of the tabs 232 on the top housing with assembly holes 234 aligned with apertures 250. Fasteners 268 are then inserted through the assembly holes 234 and fastened within the threaded apertures 250.

The embodiments thus described provide an interface module 50, 200 that each provide the capability to monitor network connections at the cross connect level. The module 50 is installed between adjacent wiring blocks 18, 19 on the cross connect 10. Individual sensor signals associated with connections to each wiring block 18, 19 are received in a pivot connector 58 on the upper side 66 of a circuit board 64 and routed via traces 103 in the circuit board 64 to a six-cable connector 60, 62 on the lower side 84 of the circuit board 64. The sensor signals are then delivered to a monitoring system through an I/O cable. Thus, network monitoring is achieved in an environment where patch cords are not used.

While the invention has been described in terms of various specific embodiments, those skilled in the art will recognize that the invention can be practiced with modification within the spirit and scope of the claims.

What is claimed is:

1. An interface module for collecting sensor signals at a cross connect block, said module comprising a circuit board having an upper side and an opposite lower side, said upper side including a plurality of upper connectors, each said upper connector receiving one sensor signal associated with a first wiring block on the cross connect block and one sensor signal associated with a second wiring block on the cross connect block different from said first wiring block, and said lower side comprising at least one connector, said at least one connector including a plurality of contacts, said sensor signals being communicated to said plurality of contacts in a pre-determined pattern.

2. The interface module of claim 1, wherein said at least one connector comprises a first connector and a second connector, wherein said first connector is associated with a first wiring block on the cross connect block and said second connector is associated with a second wiring block on the cross connect block different from said first wiring block.

3. The interface module of claim 1, wherein said circuit board includes a plurality of traces electrically connecting said plurality of upper connectors to said at least one connector.

4. The interface module of claim 1, further comprising a bottom housing and a top housing coupled to said bottom housing, said circuit board positioned between said top and bottom housings.

5. The interface module of claim 1, wherein each said individual sensor signal is carried by an associated conductor coupled with a multi-pair cabling system.

6. The interface module of claim 1, wherein said module further comprises a bottom housing and a top housing coupled to said bottom housing, said circuit board positioned between said top and bottom housings, and wherein said module is received in a space between adjacent wiring blocks on the cross connect block, said bottom housing retained in the cross connect block in snap fit engagement.

7. The interface module of claim 1, wherein each said individual sensor signal is carried by an associated conductor coupled with a multi-pair cabling system, and wherein said upper side of said circuit board includes a plurality of connectors, each of said plurality of connectors associated with one set of wiring terminations for said multi-pair cabling system on a first wiring block and one set of wiring terminations for said multi-pair cabling system on a second wiring block different from said first wiring block.

8. The interface module of claim 1, further comprising a bottom housing and a top housing coupled to said bottom housing, said circuit board positioned between said top and bottom housings, said top housing including a label holder.

9. The interface module of claim 1, wherein said at least one connector includes a latch member to retain a mating connector.

10. An interface module for collecting sensor signals at a cross connect block, said module comprising:

a bottom housing and a top housing coupled to said bottom housing; and a circuit board disposed between said top and bottom housings, said circuit board including an upper side and an opposite lower side, said upper side configured to receive a including a plurality of upper connectors, each said upper connector receiving one sensor conductor associated with a first wiring block on the cross connect block and one sensor conductor associated with a second wiring block on the cross connect block different from said first wiring block, and said lower side including at least one connector, each said sensor conductor electrically connected to said at least one connector.

11. The interface module of claim 10, wherein said circuit board includes a plurality of traces electrically connecting each of said plurality of upper connectors to said at least one connector on said lower side of said circuit board.

12. The interface module of claim 10, wherein said module is received in a space between adjacent wiring blocks on the cross connect block.

13. The interface module of claim 10, wherein said module is received in a space between adjacent wiring blocks on said cross connect block, said bottom housing retained in the cross connect block in snap fit engagement.

14. The interface module of claim 10, wherein said connector comprises an RJ-11 modular jack.

15. The interface module of claim 10, wherein each said individual sensor conductor comprises an associated conductor coupled with a multi-pair cabling system.

16. The interface module of claim 10, wherein said top housing includes a label holder.

17. The interface module of claim 10, wherein said at least one connector includes a latch member to retain a mating connector.

18. An interface module for collecting sensor signals at a cross connect block, said module comprising a circuit board having an upper side and an opposite lower side, said upper side including a plurality of upper connectors, each said upper connector configured to receive pairs of individual sensor signals, one of said pair of sensor signals associated with a first wiring block on the cross connect block and the other of said pair of sensor signals associated with a second wiring block on the cross connect block different from said first wiring block, and said lower side comprising a first lower connector and a second lower connector, wherein said first lower connector is associated with said first wiring block and said second lower connector is associated with said second wiring block, each of said plurality of upper connectors in electrical communication with each of said first and second lower connectors.

* * * * *